US008695264B1

(12) United States Patent
Blackburn et al.

(10) Patent No.: US 8,695,264 B1
(45) Date of Patent: Apr. 15, 2014

(54) GUN BARREL CLEANING TOOL AND METHOD FOR CLEANING A GUN BARREL

(71) Applicant: Courtland Group, LLC, Jacksonville, FL (US)

(72) Inventors: Courtney Blackburn, Jacksonville, FL (US); Peter Schonning, Jacksonville, FL (US); Henrik Stahre, Jacksonville, FL (US)

(73) Assignee: Courtland Group, LLC, Jacksonville, FL (US)

( * ) Notice: Subject to any disclaimer, the term of this patent is extended or adjusted under 35 U.S.C. 154(b) by 0 days.

(21) Appl. No.: 13/736,726

(22) Filed: Jan. 8, 2013

(51) Int. Cl.
*F41A 29/02* (2006.01)

(52) U.S. Cl.
USPC ..... 42/95

(58) Field of Classification Search
USPC ..... 42/95, 70.11; 15/104.05, 104.19
See application file for complete search history.

(56) References Cited

U.S. PATENT DOCUMENTS

| | | | | | |
|---|---|---|---|---|---|
| 684,981 | A | | 10/1901 | Drummond et al. | |
| 709,557 | A | | 9/1902 | Pugh | |
| 1,373,999 | A | * | 4/1921 | Drummond | 15/104.19 |
| 1,786,520 | A | * | 12/1930 | Darling | 15/104.19 |
| 2,116,392 | A | * | 5/1938 | Grasser | 15/104.19 |
| 2,628,380 | A | * | 2/1953 | Therrien | 15/104.31 |
| 2,653,334 | A | * | 9/1953 | Bay | 15/104.14 |
| 2,805,434 | A | * | 9/1957 | Hopkins | 15/104.16 |
| 2,836,251 | A | * | 5/1958 | Claypool et al. | 166/173 |
| 2,958,884 | A | * | 11/1960 | Hill et al. | 15/104.19 |
| 3,270,697 | A | * | 9/1966 | Solum | 228/144 |
| 4,783,924 | A | * | 11/1988 | Thurber | 42/70.11 |
| 5,657,570 | A | | 8/1997 | Sigier Emmanuel | |
| 5,768,741 | A | | 6/1998 | Leiman et al. | |
| 6,530,429 | B2 | * | 3/2003 | Howlett | 166/173 |
| 7,454,812 | B1 | * | 11/2008 | Lyle | 15/104.05 |
| 7,950,098 | B2 | * | 5/2011 | Veit | 15/104.05 |
| 8,499,399 | B1 | * | 8/2013 | Jones | 15/104.19 |
| 2005/0178039 | A1 | * | 8/2005 | Flores | 42/95 |
| 2006/0218735 | A1 | * | 10/2006 | Parker-Smith | 15/104.05 |
| 2008/0010765 | A1 | * | 1/2008 | Booth | 15/104.05 |
| 2008/0141474 | A1 | * | 6/2008 | Kapustin et al. | 15/104.066 |
| 2009/0320223 | A1 | * | 12/2009 | Ferreira Lino et al. | 15/104.061 |
| 2010/0199448 | A1 | * | 8/2010 | Vazales et al. | 15/104.05 |
| 2010/0294316 | A1 | * | 11/2010 | Antal et al. | 134/22.12 |
| 2011/0107646 | A1 | * | 5/2011 | Anderson | 42/95 |
| 2011/0203063 | A1 | * | 8/2011 | Atkins et al. | 15/104.05 |

FOREIGN PATENT DOCUMENTS

| | | |
|---|---|---|
| GB | 1068 | 0/1909 |

* cited by examiner

*Primary Examiner* — Bret Hayes
(74) *Attorney, Agent, or Firm* — Buchanan Ingersoll & Rooney PC

(57) ABSTRACT

A gun barrel cleaning tool includes a handle, a lock member connected to the handle, a barrel-shaped cleaning element having a fixing portion that is rotationally fixed to the lock member so that the fixing portion of the barrel-shaped cleaning element is rotationally fixed in both directions relative to the lock member, and a cleaning element having an engaging portion in rotation locking engagement with a part of the lock member so that the engaging portion is rotationally fixed in both directions relative to the part of the lock member. The cleaning element includes a cleaning portion whose outer diameter can be varied to clean gun barrels of different gauges.

19 Claims, 10 Drawing Sheets

GUN BARREL CLEANING TOOL AND METHOD FOR CLEANING A GUN BARREL

TECHNOLOGICAL FIELD

The invention generally pertains to a tool for cleaning gun barrels, and a method for cleaning gun barrels. More specifically, the invention involves a gun barrel cleaning tool configured to clean gun barrels of different gauges, and a method of cleaning such gun barrels.

BACKGROUND DISCUSSION

Owners and users of guns (e.g., rifles, pistols, shot guns, etc.) recognize the importance of cleaning gun barrels. For example, burnt powder, priming compound and metal fouling can act together to result in rusting on the inside of the barrel. The presence of rust in the gun barrel will adversely affect the gun's performance. Also, copper fouling may decrease the accuracy of at least some guns such as centrefire rifles. Excessive leading in pistol barrels or rifle barrels can also adversely affect accuracy.

A clean gun barrel is also important from a safety standpoint. Using a gun with a significantly fouled or rusty barrel can produce excessive pressure in the chamber or barrel which may give rise to safety concerns. Significant fouling buildup can also increase the pressure and therefore the recoil that is felt by the user. It is also conceivable that plastic fouling in the barrel of a shot gun can alter the shot pattern of the gun by affecting the choke characteristics.

Maintaining a clean gun barrel can thus help prevent rust, avoid a negative impact on the accuracy of the gun, avoid characteristics which might affect the gun's safety, and reduce the possibility of recoil felt by the user.

Various gun barrel cleaning implements have previously been proposed. Examples include those described in U.S. Pat. No. 684,981, U.S. Pat. No. 709,557, U.S. Pat. No. 5,657,570, U.S. Pat. No. 5,768,741 and British Published Patent Specification No. 1068.

SUMMARY

The gun barrel cleaning tool disclosed here is quite useful and versatile as it can be used to clean gun barrels of different gauge (inner diameter). According to one aspect, a gun barrel cleaning tool positionable inside gun barrels of different gauges to clean the gun barrels includes a handle, a lock member and a cleaning element. The lock member is configured to be fixed to the handle so that the handle and the lock member are fixed against rotation in opposite directions relative to one another. The lock member has a cleaning element engaging portion and a cleaning element fixing portion. The cleaning element has a lock member engaging portion, a lock member fixing portion and a spirally-extending cleaning portion connecting the lock member fixing portion and the lock member engaging portion. The spirally-extending cleaning portion includes axially adjacent windings spaced apart by respective gaps. The lock member fixing portion of the cleaning element is rotationally fixed to the cleaning element fixing portion of the lock member so that the lock member fixing portion of the cleaning element is fixed against rotation in both directions relative to the cleaning element fixing portion of the lock member. One of the cleaning element engaging portion and the lock member engaging portion includes a plurality of spaced apart projections, and the other of the cleaning element engaging portion and the lock member engaging portion includes a plurality of spaced apart recesses. The projections are positioned in the recesses in a rotationally locked position to rotationally fix the lock member engaging portion against rotation in both directions relative to the cleaning element engaging portion. The projections are also movable out of the recesses to a rotationally unlocked position in which the lock member engaging portion is rotatable in both directions relative to the cleaning element engaging portion. The lock member engaging portion in the rotationally unlocked position is rotatable in one direction relative to the cleaning element engaging portion to reduce a size of the gaps between adjacent windings of the spirally-extending cleaning portion to thus reduce an outside diameter of the spirally-extending cleaning portion. And the lock member engaging portion in the rotationally unlocked position is rotatable in the direction opposite the one direction relative to the cleaning element engaging portion to increase a size of the gaps between adjacent windings of the spirally-extending cleaning portion to thus increase an outside diameter of the spirally-extending cleaning portion.

According to another aspect, a gun barrel cleaning tool includes a handle, a lock section fixed to the handle, and a barrel-shaped cleaning element having a fixing portion that is rotationally fixed to a first part of the lock section so that the fixing portion of the barrel-shaped cleaning element is rotationally fixed in both directions relative to the first part of the lock section. The barrel-shaped cleaning element includes an engaging portion spaced from the fixing portion, wherein the engaging portion is in rotation locking engagement with a second part of the lock section so that the engaging portion is rotationally fixed in both directions relative to the second part of the lock section and the handle. The engaging portion of the barrel-shaped cleaning element is selectively disengageable from the second part of the lock section to permit rotation of the engaging portion in both directions relative to the second part of the lock section to increase or decrease an outer diameter of a cleaning portion of the barrel-shaped cleaning element and thus allow the cleaning portion to be positioned inside gun barrels of different gauges to clean the inside of the gun barrel. The cleaning portion of the barrel-shaped cleaning element is positioned between the fixed portion of the barrel-shaped cleaning element and the engaging portion of the barrel-shaped cleaning element.

According to another aspect, a gun barrel cleaning tool comprises a handle, a lock member connectable to the handle to fix the handle to the lock member at a distal end of the handle such that the handle and the lock member are rotationally fixed in both directions relative to each other, and a barrel-shaped cleaning element having a fixing portion that is rotationally fixed to the lock member so that the fixing portion of the barrel-shaped cleaning element is rotationally fixed in both directions relative to the lock member. The barrel-shaped cleaning element includes an engaging portion spaced from the fixing portion, wherein the engaging portion is in rotation locking engagement with a part of the lock member so that the engaging portion is rotationally fixed in both directions relative to the part of the lock member. The engaging portion of the barrel-shaped cleaning element is selectively disengageable from the part of the lock member to permit rotation of the engaging portion in both directions relative to the part of the lock member to increase or decrease an outer diameter of a cleaning portion of the barrel-shaped cleaning element and thus allow the cleaning portion to be positioned inside gun barrels of different gauges to clean the inside of the gun barrel. The cleaning portion of the barrel-shaped cleaning element is positioned between the fixing portion of the barrel-shaped cleaning element and the engaging portion of the barrel-shaped cleaning element.

Another aspect of the disclosure here involves a method of cleaning the inside of a gun barrel using a gun barrel cleaning tool. The gun barrel cleaning tool includes a handle and a barrel-shaped cleaning element which possesses an outer surface, with one portion of the barrel-shaped cleaning element being connected to the handle so that the one portion of the cleaning element and the handle are rotatably fixed in both directions relative to each other, and with an other portion of the barrel-shaped cleaning element being selectively rotatably locked in position relative to the handle to prevent relative rotation in opposite directions between the handle and the barrel-shaped cleaning element. The barrel-shaped cleaning element possesses a first outer diameter when the other portion of the barrel-shaped cleaning element is in a rotatably locked position relative to the handle, and the other portion of the barrel-shaped cleaning element is selectively shiftable to a rotatably unlocked position relative to the handle to permit relative rotation of the handle and the barrel-shaped cleaning element in both directions. The method involves shifting the other portion of the barrel-shaped cleaning element to the rotatably unlocked position to permit relative rotation between the handle and the barrel-shaped cleaning element in both directions, rotating the barrel-shaped cleaning element relative to the handle while the other portion of the barrel-shaped cleaning element is in the rotatably unlocked position to change the outer diameter of the barrel-shaped cleaning element from the first outer diameter to a second outer diameter, with the second outer diameter of the barrel-shaped cleaning element being greater or less than the first outer diameter, rotatably locking the other portion of the barrel-shaped cleaning element relative to the handle to prevent relative rotation between the barrel-shaped cleaning element and the handle in both directions so that the barrel-shaped cleaning element maintains the second outer diameter, and cleaning the inside of the gun barrel with the barrel-shaped cleaning element by moving the barrel-shaped cleaning element having the second outer diameter within the inside of the gun barrel while the outer surface of the barrel-shaped cleaning element contacts an inner surface of the gun barrel.

BRIEF DESCRIPTION OF THE DRAWING FIGURES

The foregoing and additional features, aspects and characteristics of the gun barrel cleaning tool and gun barrel cleaning method disclosed here will become more apparent from the following detailed description considered with reference to the accompanying drawing figures which are briefly described below.

DETAILED DESCRIPTION

Figure 1:
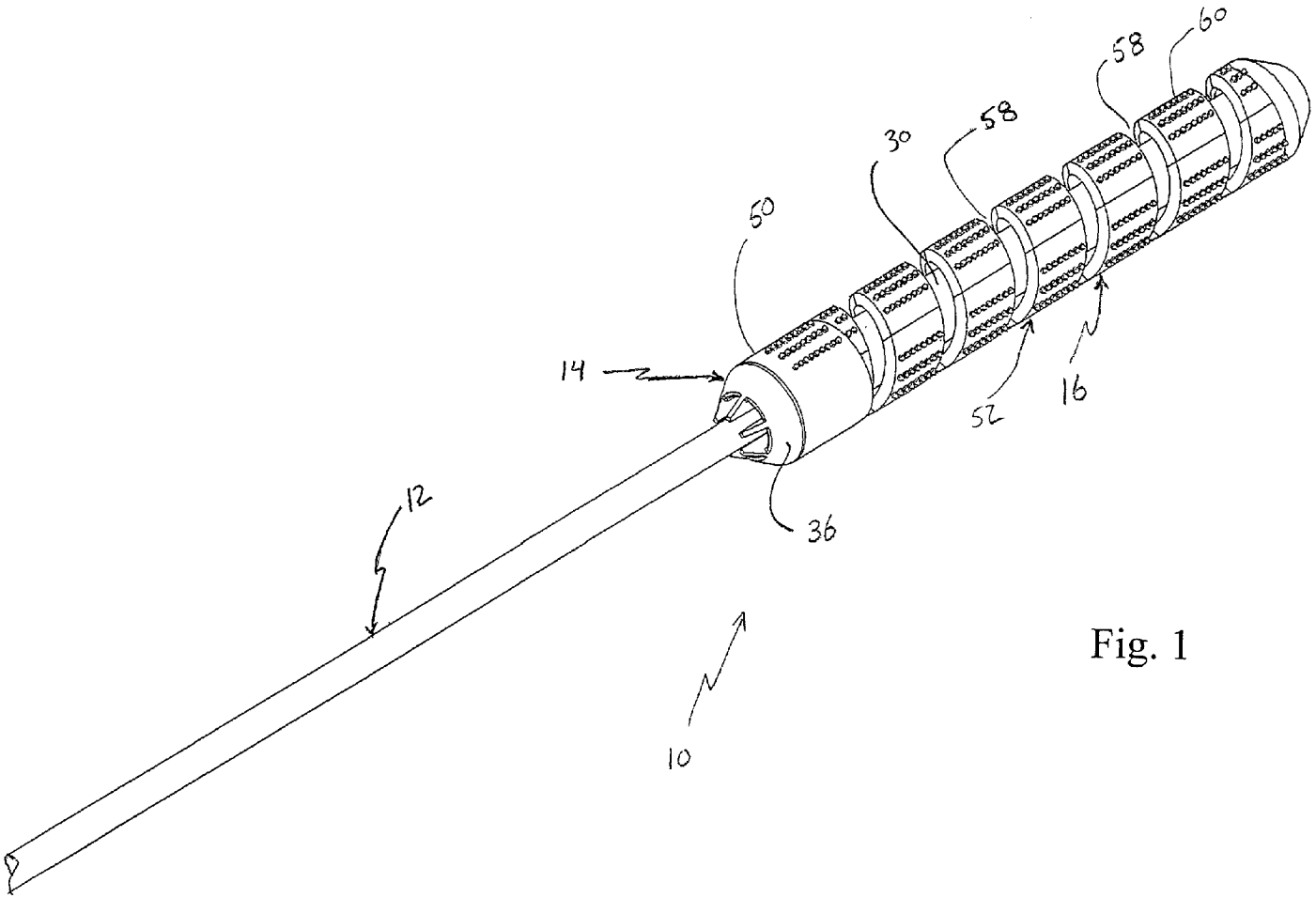
FIG. 1 is a perspective view of the gun barrel cleaning tool.

Set forth below is a detailed description of one embodiment of the gun barrel cleaning tool disclosed here by way of example. Referring initially to FIG. 1, the gun barrel cleaning tool 10 includes a handle 12, a lock member 14 and a cleaning element 16. The handle 12 is elongated and configured to be gripped by the user. The handle 12 is a straight handle and is made of a material providing a generally flexible construction, though sufficiently rigid to allow the tool to be pushed into a gun barrel as explained below in more detail. As discussed in more detail below, the distal end of the handle 12 (the right-side end of the handle in FIG. 1) is connected or fixed to the lock member 14, and the lock member 14 is connected or fixed to the cleaning element 16.

Figure 2:
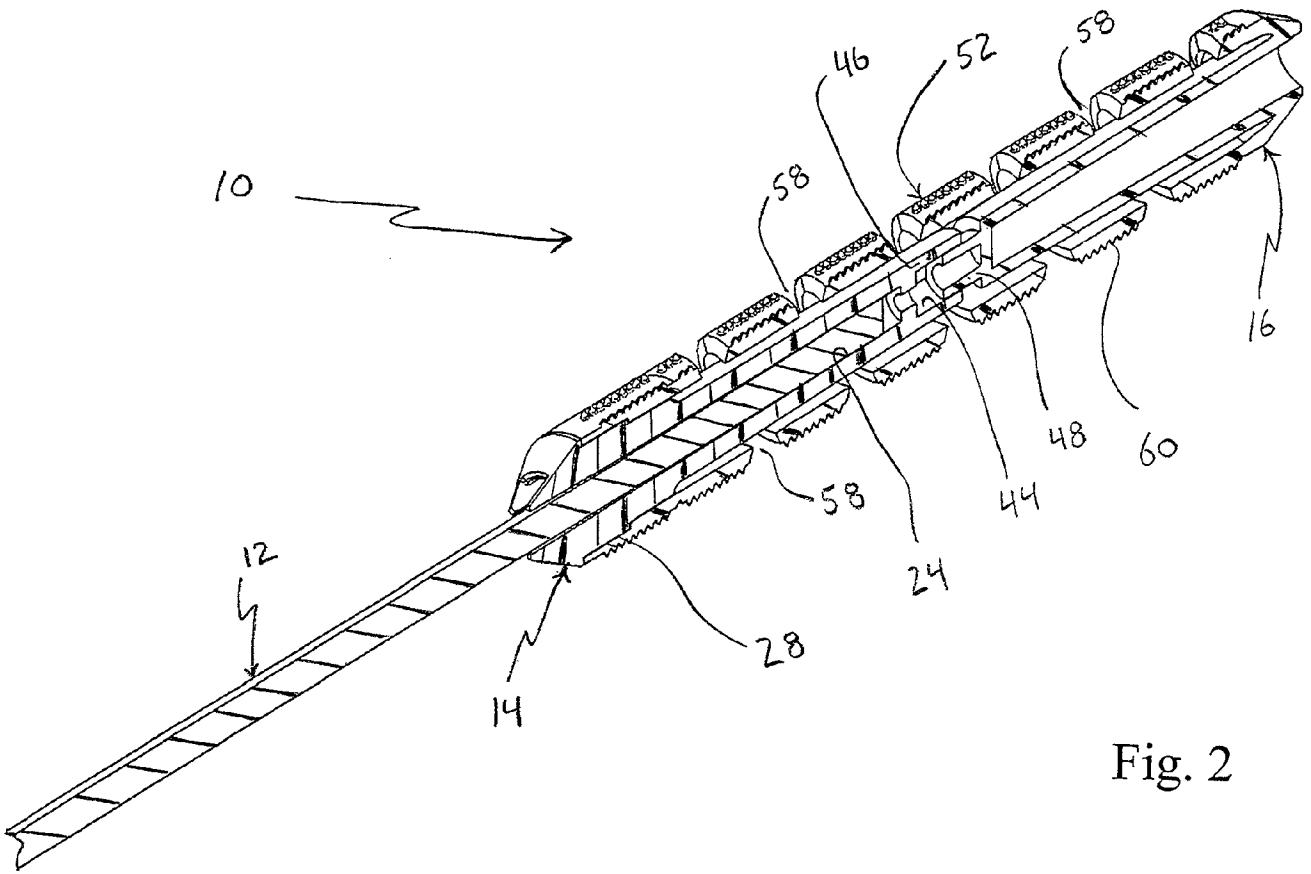
FIG. 2 is a longitudinal cross-sectional view of the gun barrel cleaning tool shown in FIG. 1.

The lock member 14 can be made of plastic material. As discussed in more detail below, the lock member 14 interacts with others aspects of the cleaning tool in a rotationally fixing and stopping manner and thus constitutes a lock section of the handle for effecting rotational locking. Referring to FIG. 2, the lock member 14 includes a generally centrally disposed bore 24 in which is positioned the distal end portion 26 of the handle 12. The distal end portion 26 of the handle 12 is rotationally fixed in place within the bore 24 in any suitable manner such as, for example, with an adhesive, by fusing, etc. The handle 12 and the lock member 14 are thus integrated together as a unit, and the handle 12 and the lock member 14 are rotationally fixed relative to one another. That is, the handle 12 and the lock member 14 are fixed against rotation in both directions relative to each other. In this illustrated embodiment, the handle 12 and the lock member 14 are fabricated as separate pieces and then connected together. It is, of course, also possible to simply make the handle 12 and the lock member 14 as a single one piece unitary construction if preferable. A part of this single one piece unitary construction would then constitute the handle and another part would constitute the lock member.

Figure 4:
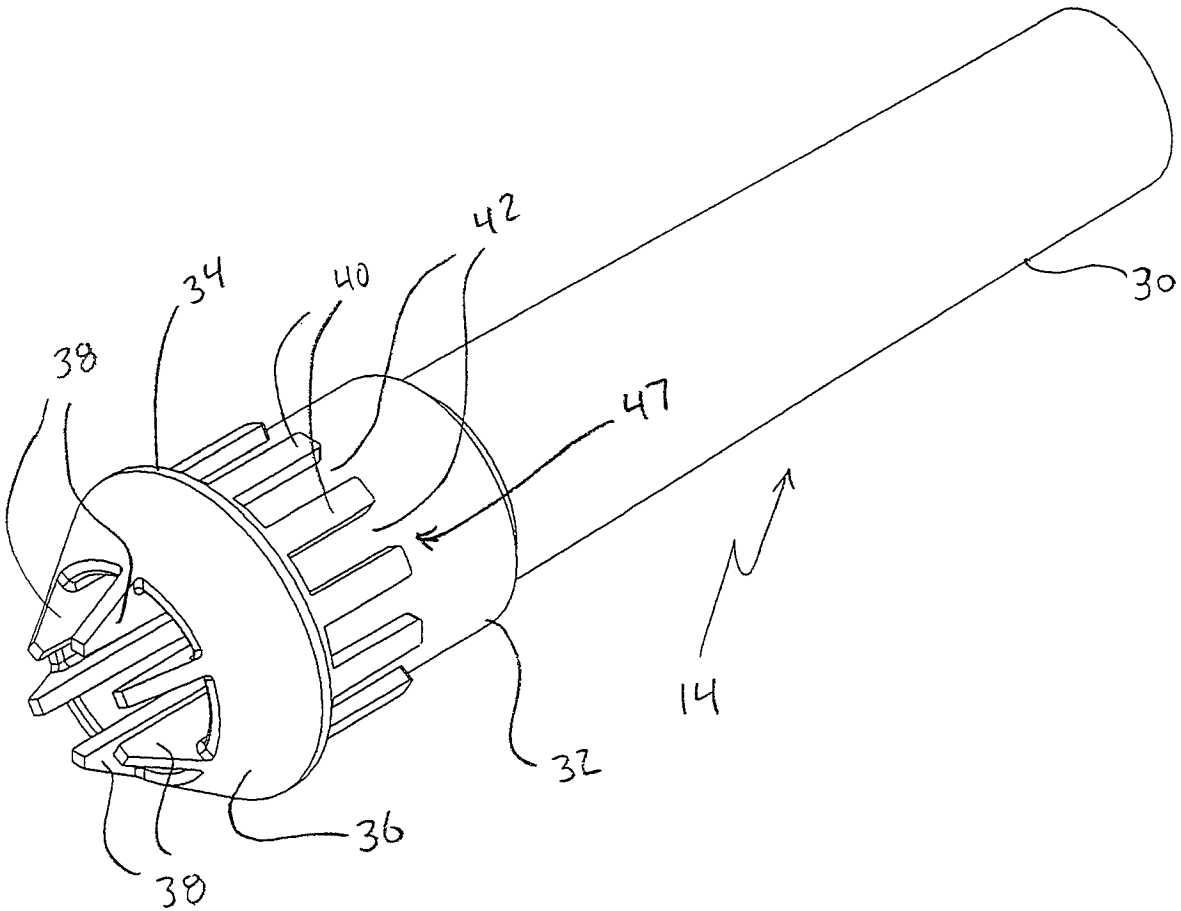
FIG. 4 is a perspective view of the lock member of the gun barrel cleaning tool shown in FIG. 1.

FIG. 4 illustrates additional details associated with the lock member 14. The lock member 14 includes a smaller diameter portion 30, a larger diameter portion 34 and an intermediate diameter portion 32. The intermediate diameter portion 32 is positioned axially between the smaller diameter portion 30 and the larger diameter portion 34. The smaller diameter portion 30 and the larger diameter portion 34 are in the form of cylindrical sections. The end of the lock member 14 remote from the smaller diameter portion 30 possesses a tapered outer surface 36 to facilitate insertion into a gun barrel. In addition, a plurality of circumferentially spaced apart axially extending tapered prongs 38 extend away from the tapered surface 36 as shown in FIG. 4.

The lock member 14 also includes a cleaning element engaging portion 47. In the illustrated embodiment, the cleaning element engaging portion 47 is located at the intermediate diameter portion 32 of the lock member 14. As described in more detail below, cleaning element engaging portion 47 is configured to interact with or engage a lock element engaging portion 47 on the cleaning element 16 in a rotationally fixed manner.

In the embodiment of the gun barrel cleaning tool disclosed here and illustrated in the drawing figures, the cleaning element engaging portion 47 of the lock member 14 (lock section of the handle) is in the form of a plurality of alternating projections 40 and recesses 42. That is, the intermediate diameter portion 32 of the lock member 14 includes a plurality of circumferentially spaced apart projections 44, with the spaces between circumferentially adjacent projections 40 defining recesses 42.

As illustrated in FIG. 2, the end of the lock member 14 remote from the handle 12 includes a bore 44. This bore 44 receives a portion of the cleaning element 16 (e.g., the endmost portion of the cleaning element 16). The lock member 14 thus includes a cleaning element fixing portion 46, and the cleaning element 16 includes a lock member fixing portion 48. The cleaning element fixing portion 46 of the lock member 14 fixedly engages the lock member fixing portion 48 of the cleaning element 16 such that the cleaning element fixing portion 46 and the lock member fixing portion 48 are fixed against rotation in both directions relative to one another. The cleaning element fixing portion 46 of the lock member 16 and the lock member fixing portion 48 of the cleaning element 16 can be rotationally fixed in any appropriate manner, for example by adhesive, fusion, etc. Also, the cleaning element fixing portion 46 of the lock member 16 and the lock member fixing portion 48 of the cleaning element 16 can be configured differently than illustrated in FIG. 2, for example, the cleaning element fixing portion 46 of the lock member 16 can be fitted into a hole in the lock member fixing portion 48 of the cleaning element 16.

Figure 3:
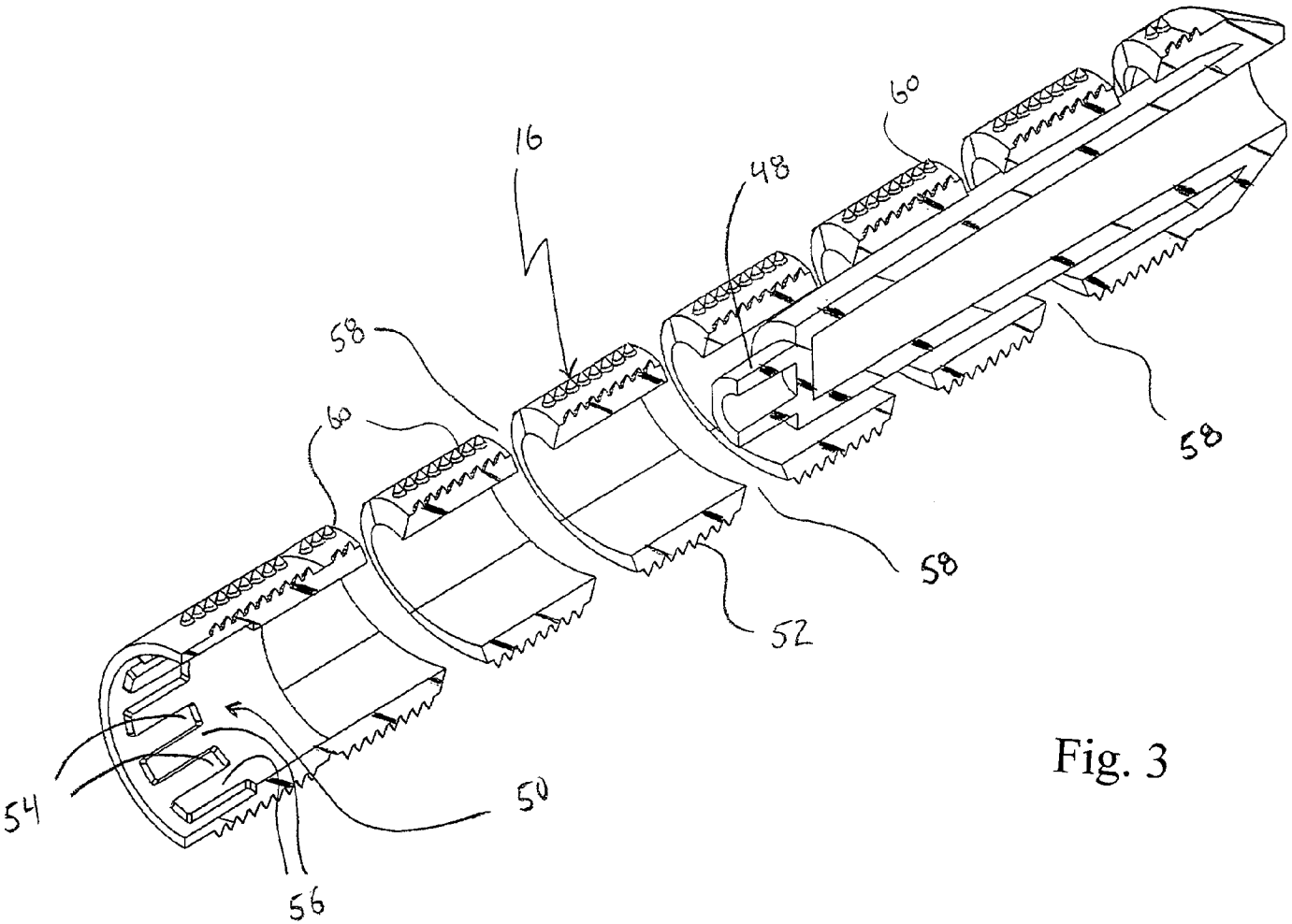
FIG. 3 is a longitudinal cross-sectional view of the cleaning element of the gun barrel cleaning tool shown in FIG. 1.

FIG. 3 illustrates additional details associated with the cleaning element 16. The cleaning element 16 is preferably made of plastic material. The cleaning element 16 includes the lock member fixing portion 48, a lock member engaging portion 50, and a cleaning portion 52. In this disclosed embodiment, the lock member engaging portion 50 is positioned at one free end of the cleaning element 16, the lock member fixing portion 48 is at the opposite free end of the cleaning element 16, and the cleaning portion 52 extends between the lock member fixing portion 48 and the lock member engaging portion 50. In the illustrated embodiment, the lock member fixing portion 48 of the cleaning element 16 is positioned inside the cleaning portion 52 of the cleaning element 16. That is, the cleaning portion 52 of the cleaning element 16 includes a hollow interior, and the lock member fixing portion 48 is positioned in the hollow interior of the cleaning portion 52. The lock member fixing portion 48 and the cleaning portion 52 of the cleaning element 16 are coaxial with each another, with the lock member fixing portion 48 axially overlapping a part of the cleaning portion 52. As illustrated in FIG. 3, the lock member fixing portion 48 is a cantilever section of the cleaning element 16.

The lock member engaging portion 50 of the cleaning element 16 is in the form of a plurality of circumferentially spaced apart projections 54 and recesses 56. The spaces between circumferentially adjacent projections 54 define the recesses 56. The alternating projections 54 and recesses 56 are circumferentially arranged about the inner surface at the end of the cleaning element 16.

FIG. 2 illustrates that the projections 54 on the lock member engaging portion 50 of the cleaning element 16 engage the recesses 42 of the cleaning element engaging portion 47 of the lock member 14. Similarly, the projections 40 on the cleaning element engaging portion 47 of the lock member 14 engage the recesses 56 of the lock member engaging portion 50 of the cleaning element 16. This engagement between the projections and recesses results in the lock member engaging portion 50 of the cleaning element 16 and the cleaning element engaging portion 47 of the lock member 14 being rotationally fixed against rotation relative to each other (rotation fixed state). This rotation fixed state of the gun barrel cleaning tool can be changed to a rotation permitting state by axially moving the lock member engaging portion 50 of the cleaning element 16 away from the cleaning element engaging portion 47 of the lock member 14 to cause the projections and recesses 56, 54 of the lock member engaging portion 50 of the cleaning element 16 to be disengaged from the projections and recesses 40, 42 of the cleaning element engaging portion 47 of the lock member 14. Once the projections and recesses 56, 54 of the lock member engaging portion 50 of the cleaning element 16 are disengaged from the projections and recesses 40, 42 of the cleaning element engaging portion 47 of the lock member 14, the lock member engaging portion 50 can be rotated in opposite directions relative to the cleaning element engaging portion 47 to thus change the outer diameter of the cleaning portion 52.

As seen in FIG. 3, the cleaning element 16, including the cleaning portion 52, is barrel-shaped so that it is positionable inside a gun barrel. The cleaning portion 52 of the cleaning element 16 is in the form of a spirally-extending cleaning portion 52 (spiral-shaped element). The spirally-extending cleaning portion 52 includes axially adjacent windings that are spaced apart by respective gaps as seen in FIGS. 1-3.

Figure 5:
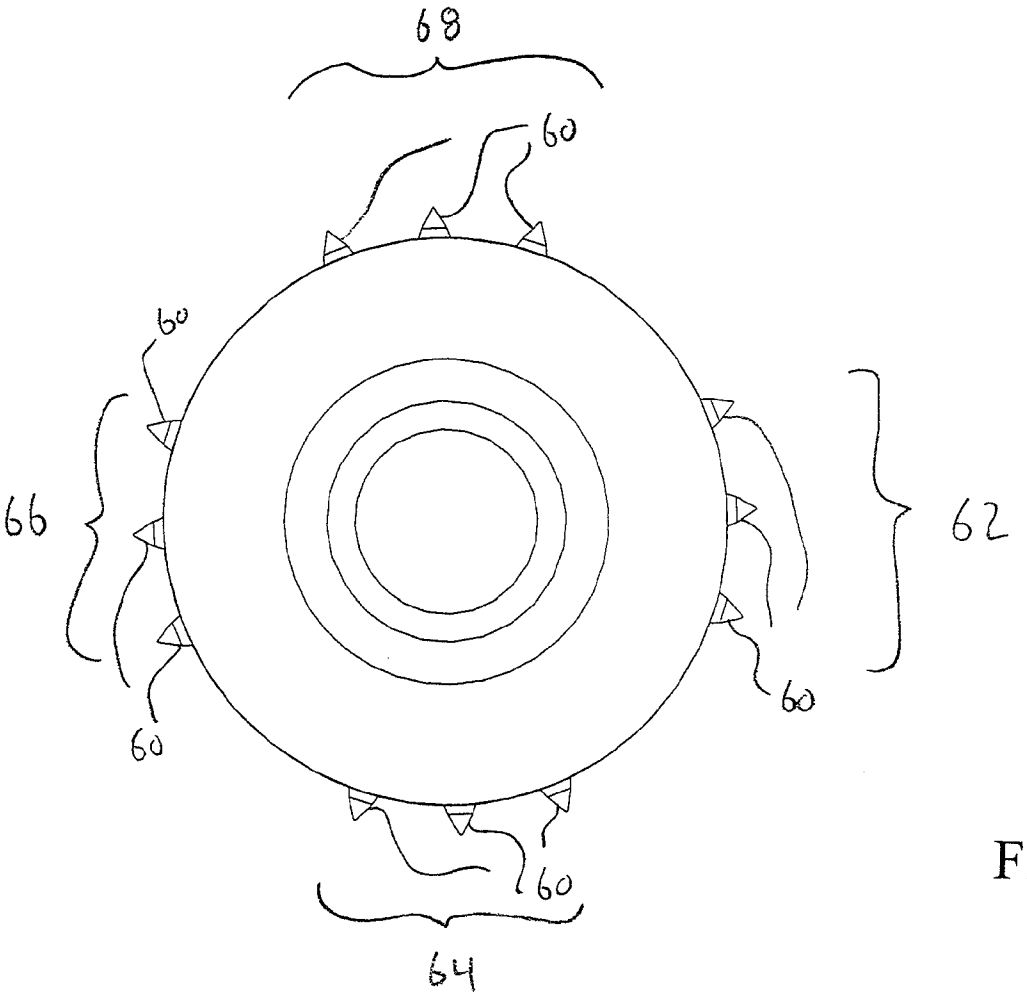
FIG. 5 is an end view of the gun barrel cleaning tool illustrating the groups of upstanding protrusions on the outer surface of the cleaning portion of the cleaning element.

The outwardly facing outer surface of the cleaning portion 52 of the cleaning element 16 includes a plurality of upstanding protrusions 60 as seen in FIGS. 1-3. In the illustrated embodiment, these protrusions are tapered in a narrowing manner toward their tip ends for reasons that will become apparent from the description below. In this embodiment of the cleaning tool disclosed by way of example, the upstanding protrusions 60 preferably terminate at a pointed end. The upstanding protrusions 60 can be arranged in the manner illustrated in FIGS. 1-3, namely as a plurality of longitudinally extending lines of protrusions, with the lines of protrusions extending parallel to the longitudinal axis of the gun barrel cleaning tool. As illustrated in FIG. 5, the upstanding protrusions 60 can be arranged in four groups 62, 64, 66, 68, generally arranged at 90 degree intervals relative to each other. More specifically, the four groups of protrusions include a first group of protrusions 62, a second group of protrusions 64, a third group of protrusions 66 and a fourth group of protrusions 68. In the illustrated arrangement, the first group 62 of protrusions is positioned circumferentially between and circumferentially spaced from the second and fourth groups 64, 68, the second group 64 is positioned circumferentially between and circumferentially spaced from the first and third groups 62, 66, the third group 66 is positioned circumferentially between and circumferentially spaced from second and fourth groups 64, 68, and the fourth group 68 is positioned circumferentially between and circumferentially spaced from the first and third groups 62, 66. Of course, the arrangement of the protrusions is not limited in this regard as the protrusions can be arranged on the outer surface of the cleaning portion in other ways.

Having described the features of the gun barrel cleaning tool, set forth below is a description of a manner of using, and the operation of the gun barrel cleaning tool. FIGS. 1 and 2 illustrate the gun barrel cleaning tool in the rotation locked position, prior to use. In this position, the lock member engaging portion 50 of the cleaning element 16 is rotationally fixed relative to the cleaning element engaging portion 47 of the lock member 14. The lock member engaging portion 50 of the cleaning element 16 is thus in a rotatably locked position. While holding the handle 12, the user can grasp the outer surface of the lock member engaging portion 50 of the cleaning element 16 and pull it axially away from the portion of the handle 12 being held by the user to move the lock member engaging portion 50 of the cleaning element 16 away from the lock section of the handle. More specifically, the lock member engaging portion 50 of the cleaning element 16 and the cleaning element engaging portion 47 of the lock member 14 move out of engagement with one another. As a result, the projections and recesses 40, 42 on the lock member 14, and the projections and recesses 54, 56 on the cleaning element 16 no longer engage one another. In thus rotatably unlocked position of the lock member engaging portion 50 of the cleaning element 16, it is possible to rotate the lock member engaging portion 50 of the cleaning portion 16 relative to the cleaning element engaging portion 47 of the lock member 14 (i.e., the lock member engaging portion 50 of the cleaning portion 16 can be rotated relative to the handle 12). Because the lock member engaging portion 50 of the cleaning element 16 is rotationally fixed relative to the cleaning element fixing portion 46 of the lock member 16, rotation of the lock member engaging portion 50 of the cleaning portion 16 relative to the cleaning element engaging portion 47 of the lock member 14 causes the outer diameter of the cleaning portion 52 (i.e., the outer diameter defined by the tips of the upstanding protrusions 60) to change. That is, rotating the lock member engaging portion 50 in one direction relative to the cleaning element engaging portion 47 of the lock member 14 decreases the size of the gaps between the spiral windings of the cleaning portion 52 and thus reduces the outer diameter of the cleaning portion 16. On the other hand, rotating the lock member engaging portion 50 of the cleaning element 16 relative to the cleaning element engaging portion 47 of the lock member 14 increases the size of the gaps 58 between the axially adjacent spiral windings of the cleaning portion 52 to thus increase the outer diameter of the cleaning portion. Adjusting the outer diameter of the cleaning portion 52 in this way allows the gun barrel cleaning tool to be used to clean guns having different barrel gauges (i.e., guns having barrels with different inner diameters).

That is, the outer diameter of the cleaning portion can be varied to accommodate different barrels of different gauge. The gun barrel cleaning tool can thus be used to clean guns having, for example, 12-gauge, 16-gauge and 20-gauge barrels. It is possible to outfit the tool with appropriate markings indicating the different diameter/gauges so that the user would know how far to rotate the lock member engaging portion 50 to achieve a certain outer diameter and certain barrel gauge. The markings could be provided on the lock member engaging portion 50 and the portions 34 or 36. For example, the portion 34 or 36 could be provided with the diameter/gauges, while the lock member engaging portion 50 is provided with an indicator such as an arrow, or vice versa. Aligning the indicator with the diameter/gauges will indicate to the user that the outer diameter of the cleaning tool has been set for the noted diameter/gauges of gun barrel.

After the outer diameter of the cleaning portion 52 is adjusted, the lock member engaging portion 50 of the cleaning element 16 is moved axially toward the cleaning element engaging portion 47 of the lock member 14 so that the projections and recesses 54, 56 on the cleaning element 16 once again engage the projections and recesses 40, 42 on the lock member 14. The axial returning movement of the lock member engaging portion 50 toward the cleaning element engaging portion 47 is aided by the natural restoring force of the material forming the spiral-shaped cleaning portion 52 (cleaning element). The engagement of the projections and recesses 54, 56 on the cleaning element 16 with the projections and recesses 40, 42 on the lock member 14 fixes the lock member engaging portion 50 of the cleaning element 16 against rotation in both directions relative to the cleaning element engaging portion 47 of the lock member 14.

To clean a gun barrel using the gun barrel cleaning tool 10, the user adjusts the outer diameter of the cleaning portion 52 of the gun barrel cleaning tool 10 in the manner described above. The outer diameter of the cleaning portion 52 is adjusted so that the outer diameter defined by the tips of the upstanding projections 60 is about the same as (equal to or greater than) the inner diameter of the gun barrel. The cleaning portion 52 of the gun barrel cleaning tool 10 is then inserted into the gun barrel and axially moved back and forth along the length of the gun barrel so that the protrusions scrub or scrape the inner surface of the gun barrel and loosen any residue. The spiral-shape of the cleaning portion 52 imparts a degree of flexibility to the cleaning portion 52. This means that when the outer diameter defined by the tips of the upstanding projections 60 is adjusted to fit the gun barrel, the outer diameter can be set to be slightly larger than the inner diameter of the barrel (i.e., the gauge of the barrel), When the cleaning portion 52 of the cleaning tool is then inserted into the gun barrel, the cleaning portion is able to flex or give a little to accommodate the slightly smaller inner diameter of the gun barrel. The upstanding protrusions 60 are thus pressed strongly against the inner surface of the barrel to facilitate effective scrubbing Once the inner surface of the gun barrel has been scrubbed in this way, a dry cleaning cloth can be wrapped around the cleaning portion 52 of the gun barrel cleaning tool. The cleaning portion 52, with the wrapped cloth, can then be once again inserted into the gun barrel to clean the gun barrel inner surface. The upstanding protrusions 60 on the cleaning portion help grip and hold the cloth during this cleaning. It is also possible to use, in addition to the clean cloth or as an alternative to the clean cloth, a cloth that is pre-soaked in solvent. As an alternative to the cloth pre-soaked in solvent, a clean cloth and solvent can be supplied separately so that the solvent can be applied to the cloth by the user. The solvent-soaked cloth can be wrapped around the cleaning portion 52 of the tool, whereupon the cleaning portion 52, with the wrapped solvent-soaked cloth, is inserted into the gun barrel to help clean the gun barrel inner surface. A cloth pre-soaked in oil can also be used to oil the gun barrel. Instead of a cloth pre-soaked in oil, a clean cloth and oil can be supplied separately so that the oil can be applied to the cloth by the user. The oil-soaked cloth can be wrapped around the cleaning portion 52 of the tool, whereupon the cleaning portion 52, with the wrapped oil-soaked cloth, is inserted into the gun barrel to apply oil to the inner surface of the gun barrel.

Figure 6:
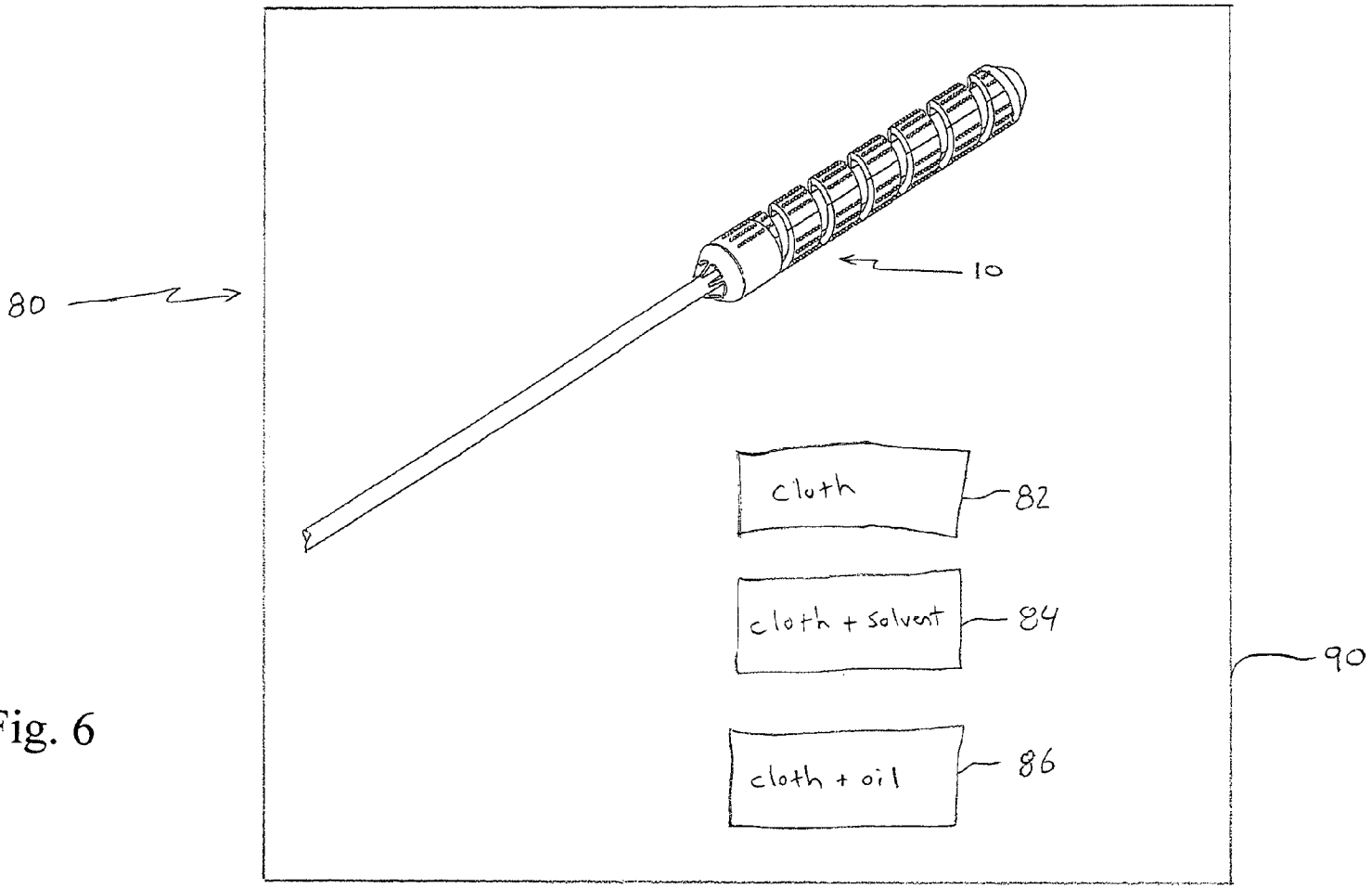
FIG. 6 illustrates a gun barrel cleaning kit that includes the gun barrel cleaning tool shown in FIGS. 1 and 2, and other parts.

It is also possible to sell the gun barrel cleaning tool as part of a kit 80, an example of which is schematically illustrated in FIG. 6. The kit 80 could include the gun barrel cleaning tool 10, a clean cloth 82 for cleaning the inside of the barrel after scraping with the upstanding protrusions as described above, a cloth+solvent 84 as described above, and a cloth+oil 86 as discussed above. The FIG. 6 depiction of the cloth+solvent 84 encompasses a cloth pre-soaked with solvent as well as solvent separate from the cloth so that the user can apply the solvent to the cloth during use. Similarly, the FIG. 6 depiction of the cloth+oil 86 encompasses a cloth pre-soaked with oil as well as oil separate from the cloth so that the user can apply the oil to the cloth during use. The gun barrel cleaning tool 10, the clean cloth 82, the cloth+solvent 84, and the cloth+oil 86 forming the kit 80 can be packaged in suitable packaging 90 schematically shown in FIG. 6.

Figure 7:
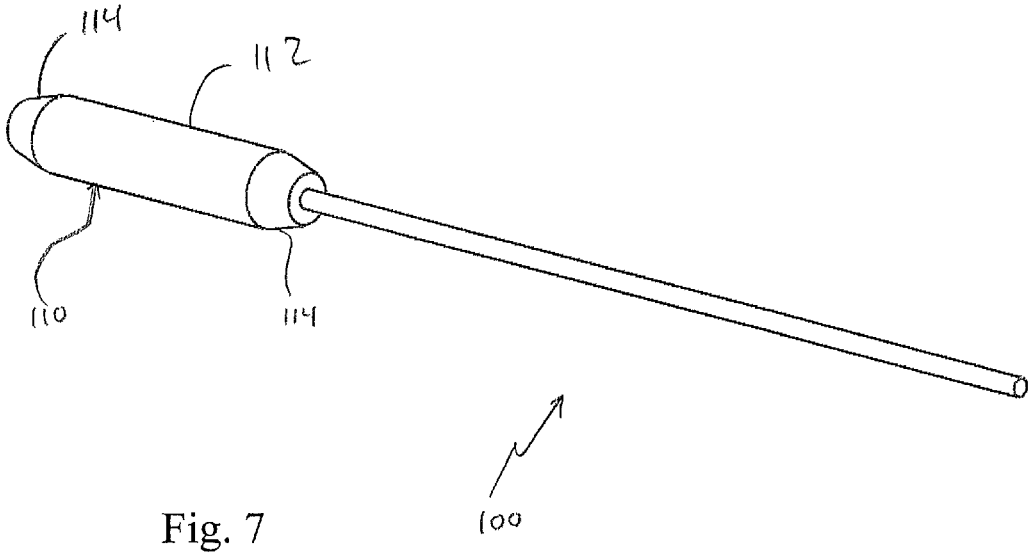
FIG. 7 is a perspective view of an alternative embodiment of the gun barrel cleaning tool.
Figure 8:
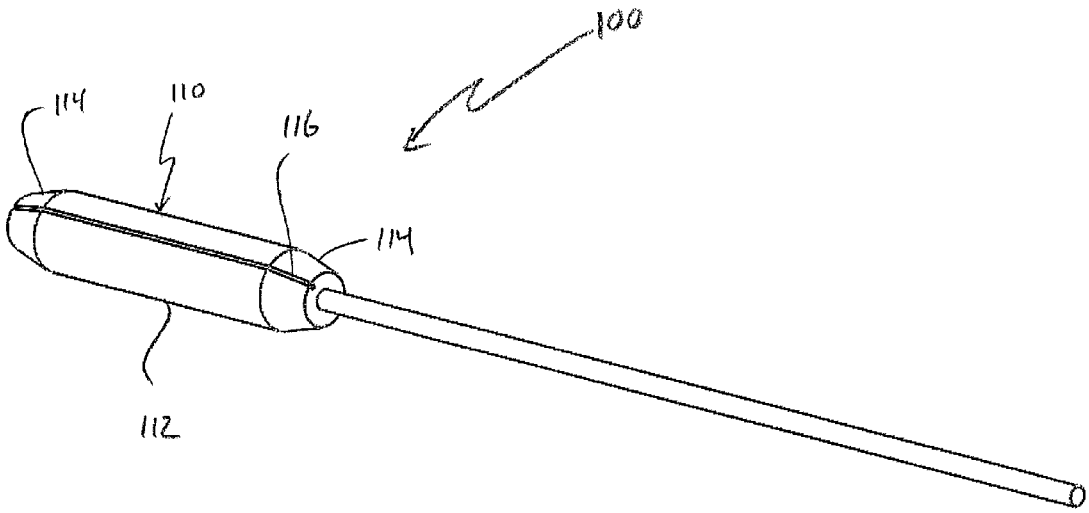
FIG. 8 is another perspective view of the gun barrel cleaning tool shown in FIG. 7.

FIGS. 7 and 8 illustrate another embodiment of the gun barrel cleaning tool exhibiting. This version of the gun barrel cleaning tool has useful application for performing a relatively quick and perhaps less extensive cleaning of the gun barrel compared to the gun barrel cleaning tool shown in FIGS. 1-6 which is constructed to provide a more thorough cleaning. The gun barrel cleaning tool 100 illustrated in FIGS. 7 and 8 includes a cleaning portion 110 fixed to a handle 120. The cleaning portion 110 is configured, along its axial or longitudinal extent, to include a central or intermediate portion 112 constituting a main body portion and tapering axial end portions 114 that taper in a narrowing fashion in a direction away from the intermediate portion 112. The entirety of the cleaning portion 110 is preferably made of a foam material that exhibits the ability to be compressed to a smaller circumferential size (e.g., when positioned in a gun barrel), while automatically returning to its larger original size upon removal of the compressive force (e.g., when removed from the gun barrel). This allows the cleaning portion 110 of the cleaning tool to be positioned inside a gun barrel and pulled through the gun barrel by way of the handle 120 while the outer surface of the intermediate main body 112 contacts and cleans the inner surface of the barrel. As illustrated in FIG. 8, the cleaning portion 110 can be configured to include an axially extending slit 116 extending along the entire axial extent of the cleaning portion 110. This axial slit 116 helps facilitate compression of the cleaning portion when the cleaning portion is fitted into a gun barrel. Ideally, the main body portion 112 of the cleaning portion will possess an outer diameter slightly greater than the inner diameter of the barrel to be cleaned by the cleaning tool.

This version of the gun barrel cleaning tool illustrated in FIGS. 7 and 8 would ideally be used by inserting the handle 120 through the front end of the gun barrel, and then pulling the cleaning portion 110 through the gun barrel by way of the handle 120. The handle 120 can be made of a flexible material such as rope or the like.

Figure 9:
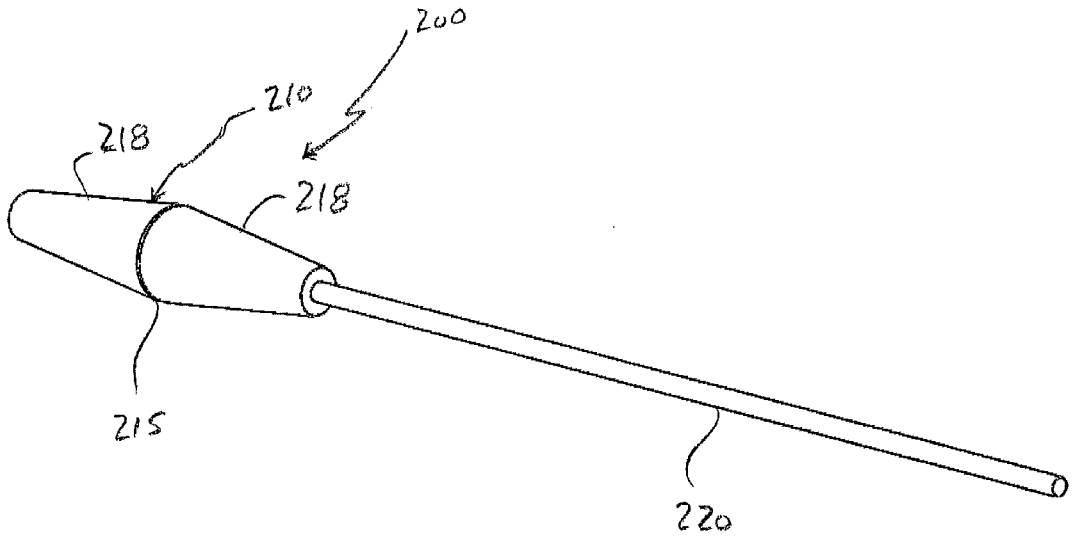
FIG. 9 is a perspective view of a another embodiment of the gun barrel cleaning tool.
Figure 10:
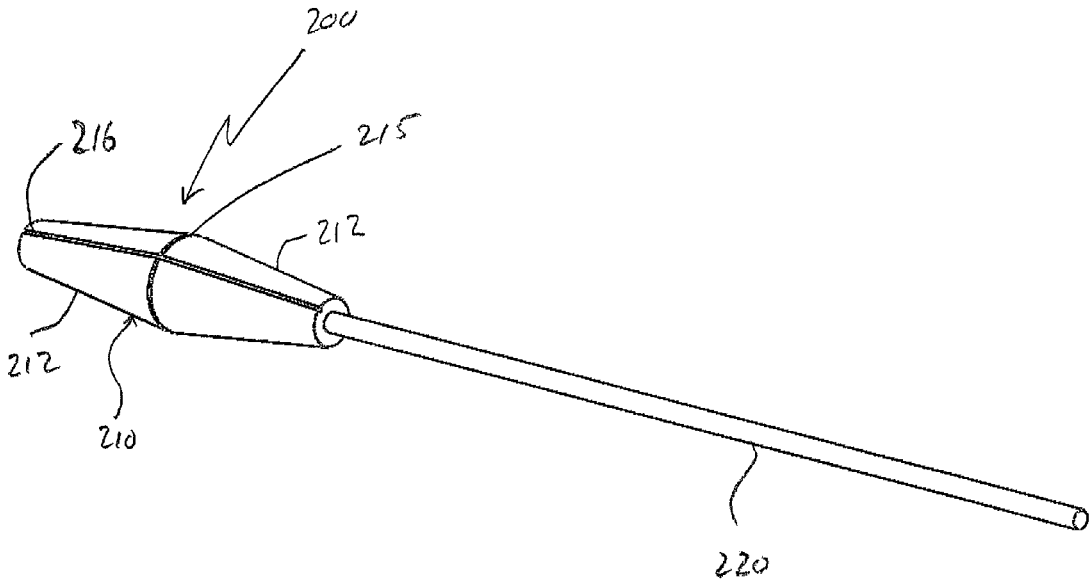
FIG. 10 is another perspective view of the gun barrel cleaning tool shown in FIG. 9.

FIGS. 9 and 10 illustrate a slight variation on the gun barrel cleaning tool shown in FIGS. 7 and 8. In the embodiment shown in FIGS. 9 and 10, the gun barrel cleaning tool 200 includes a cleaning portion 210 fixed to a handle 220. The cleaning portion 210 is comprised of two tapered portions 218, 218 that taper an a narrowing manner from a central portion 215 of the cleaning portion 210. The cleaning portion 210 in this embodiment of the cleaning tool can also be provided with an axially or longitudinally extending slit 216 to facilitate compression of the foam material forming the cleaning portion 210. Once again, the handle 220 can be made of rope or the like.

The detailed description above describes embodiments of a gun barrel cleaning tool, a method of cleaning a gun barrel and a kit that includes the gun barrel cleaning tool and other items to facilitate gun barrel cleaning. The invention here is not limited, however, to the precise embodiment and variations described. Various changes, modifications and equivalents could be effected by one skilled in the art without departing from the spirit and scope of the invention as defined in the appended claims. It is expressly intended that all such changes, modifications and equivalents which fall within the scope of the claims are embraced by the claims.

What is claimed is:

1. A gun barrel cleaning tool positionable inside gun barrels of different gauges to clean the gun barrels, the gun barrel cleaning tool comprising:

a handle;

a lock member configured to be fixed to the handle so that the handle and the lock member are fixed against rotation in opposite directions relative to one another, the lock member including a cleaning element engaging portion and a cleaning element fixing portion;

a cleaning element, the cleaning element comprising a lock member engaging portion, a lock member fixing portion and a spirally-extending cleaning portion connecting the lock member fixing portion and the lock member engaging portion;

the spirally-extending cleaning portion comprising adjacent windings spaced apart by respective gaps;

the lock member fixing portion of the cleaning element being rotationally fixed to the cleaning element fixing portion of the lock member so that the lock member fixing portion of the cleaning element is fixed against rotation in both directions relative to the cleaning element fixing portion of the lock member;

one of the cleaning element engaging portion and the lock member engaging portion including a plurality of spaced apart projections, and the other of the cleaning element engaging portion and the lock member engaging portion including a plurality of spaced apart recesses, the projections being positioned in the recesses in a rotationally locked position to rotationally fix the lock member engaging portion against rotation in both directions relative to the cleaning element engaging portion;

the projections being movable out of the recesses to a rotationally unlocked position in which the lock member engaging portion is rotatable in both directions relative to the cleaning element engaging portion;

the lock member engaging portion in the rotationally unlocked position being rotatable in one direction relative to the cleaning element engaging portion to reduce a size of the gaps between adjacent windings of the spirally-extending cleaning portion to thus reduce an outside diameter of the spirally-extending cleaning portion; and the lock member engaging portion in the rotationally unlocked position being rotatable in the direction opposite the one direction relative to the cleaning element engaging portion to increase a size of the gaps between adjacent windings of the spirally-extending cleaning portion to thus increase an outside diameter of the spirally-extending cleaning portion.

2. The gun barrel cleaning tool according to claim 1, further comprising a plurality of upstanding protrusions on an outwardly facing outer surface of the cleaning portion.

3. The gun barrel cleaning tool according to claim 2, wherein:

the plurality of upstanding protrusions on the outwardly facing outer surface of the cleaning portion includes a first group of upstanding protrusions, a second group of upstanding protrusions, a third group of upstanding protrusions, and a fourth group of upstanding protrusions;

the first group of upstanding protrusions being positioned circumferentially between, and being circumferentially spaced from, the fourth group of upstanding protrusions and the second group of upstanding protrusions;

the second group of upstanding protrusions being positioned circumferentially between, and being circumferentially spaced from, the first group of upstanding protrusions and the third group of upstanding protrusions;

the third group of upstanding protrusions being positioned circumferentially between, and being circumferentially spaced from, the second group of upstanding protrusions and the fourth group of upstanding protrusions; and the fourth group of upstanding protrusions being positioned circumferentially between, and being circumferentially spaced from, the third group of upstanding protrusions and the first group of upstanding protrusions.

4. The gun barrel cleaning tool according to claim 1, wherein the cleaning element is made of plastic.

5. A gun barrel cleaning tool positionable inside gun barrels of different gauges to clean the gun barrel, the gun barrel cleaning tool comprising:

a handle;

a lock section fixed to the handle;

a barrel-shaped cleaning element possessing an outer surface, the barrel-shaped cleaning element including a fixing portion that is rotationally fixed to a first part of the lock section so that the fixing portion of the barrel-shaped cleaning element is rotationally fixed in both directions relative to the first part of the lock section;

the barrel-shaped cleaning element including an engaging portion spaced from the fixing portion, the engaging portion being in rotation locking engagement with a second part of the lock section so that the engaging portion is rotationally fixed in both directions relative to the second part of the lock section and the handle; and the engaging portion of the barrel-shaped cleaning element being selectively disengageable from the second part of the lock section to permit rotation of the engaging portion in both directions relative to the second part of the lock section to increase or decrease an outer diameter of a cleaning portion of the barrel-shaped cleaning element and thus allow the cleaning portion to be positioned inside gun barrels of different gauges to clean the inside of the gun barrel, the cleaning portion of the barrel-shaped cleaning element being positioned between the fixed portion of the barrel-shaped cleaning element and the engaging portion of the barrel-shaped cleaning element.

6. The gun barrel cleaning tool according to claim 5, wherein the lock section is a part of a lock member, the lock member being separate from the handle and fixed to the handle.

7. The gun barrel cleaning tool according to claim 5, wherein the engaging portion of the barrel-shaped cleaning element is located inside the cleaning portion.

8. The gun barrel cleaning tool according to claim 5, wherein the cleaning portion of the barrel-shaped cleaning element is a spiral-shaped cleaning portion with a gap between adjacent windings of the spiral-shaped cleaning portion, the spiral-shaped cleaning portion surrounding a hollow interior, and the fixing portion of the barrel-shaped cleaning element being located inside the hollow interior of the cleaning portion.

9. The gun barrel cleaning tool according to claim 5, wherein the engaging portion of the barrel-shaped cleaning element is located at an end-most portion of the barrel-shaped cleaning element.

10. A gun barrel cleaning tool positionable inside different gun barrels of different gauges to clean the gun barrel, the gun barrel cleaning tool comprising:

a handle;

a lock member connectable to the handle to fix the handle to the lock member at a distal end of the handle such that the handle and the lock member are rotationally fixed in both directions relative to each other;

a barrel-shaped cleaning element possessing an outer surface, the barrel-shaped cleaning element including a fixing portion that is rotationally fixed to the lock member so that the fixing portion of the barrel-shaped cleaning element is rotationally fixed in both directions relative to the lock member;

the barrel-shaped cleaning element including an engaging portion spaced from the fixing portion, the engaging portion being in rotation locking engagement with a part of the lock member so that the engaging portion is rotationally fixed in both directions relative to the part of the lock member; and the engaging portion of the barrel-shaped cleaning element being selectively disengageable from the part of the lock member to permit rotation of the engaging portion in both directions relative to the part of the lock member to increase or decrease an outer diameter of a cleaning portion of the barrel-shaped cleaning element and thus allow the cleaning portion to be positioned inside gun barrels of different gauges to clean the inside of the gun barrel, the cleaning portion of the barrel-shaped cleaning element being positioned between the fixing portion of the barrel-shaped cleaning element and the engaging portion of the barrel-shaped cleaning element.

11. The gun barrel cleaning tool according to claim 10, further comprising a plurality of spaced apart and upstanding protrusions on an outer surface of the cleaning portion, each of the protrusions tapering in a narrowing manner towards free ends of the protrusions.

12. The gun barrel cleaning tool according to claim 10, wherein the engaging portion of the barrel-shaped cleaning element is located inside the cleaning portion.

13. The gun barrel cleaning tool according to claim 10, wherein the cleaning portion of the barrel-shaped cleaning element is a spiral-shaped cleaning portion with a gap between adjacent windings of spiral-shaped cleaning portion, the spiral-shaped cleaning portion surrounding a hollow interior, and the engaging portion of the barrel-shaped cleaning element being located inside the hollow interior of the cleaning portion.

14. The gun barrel cleaning tool according to claim 10, wherein the fixing portion of the barrel-shaped cleaning element is located at an end-most portion of the barrel-shaped cleaning element.

15. A method of cleaning inside a gun barrel using a gun barrel cleaning tool, the gun barrel cleaning tool comprising a handle and a barrel-shaped cleaning element which possesses an outer surface, one portion of the barrel-shaped cleaning element being connected to the handle so that the one portion of the cleaning element and the handle are rotatably fixed in both directions relative to each other, an other portion of the barrel-shaped cleaning element being selectively rotatably locked in position relative to the handle to prevent relative rotation in opposite directions between the handle and the barrel-shaped cleaning element, the barrel-shaped cleaning element possessing a first outer diameter when the other portion of the barrel-shaped cleaning element is in a rotatably locked position relative to the handle, the other portion of the barrel-shaped cleaning element being selectively shiftable to a rotatably unlocked position relative to the handle to permit relative rotation of the handle and the barrel-shaped cleaning element in both directions, the method comprising:

shifting the other portion of the barrel-shaped cleaning element to the rotatably unlocked position to permit relative rotation between the handle and the barrel-shaped cleaning element in both directions;

rotating the barrel-shaped cleaning element relative to the handle while the other portion of the barrel-shaped cleaning element is in the rotatably unlocked position to change the outer diameter of the barrel-shaped cleaning element from the first outer diameter to a second outer diameter, the second outer diameter of the barrel-shaped cleaning element being greater or less than the first outer diameter;

rotatably locking the other portion of the barrel-shaped cleaning element relative to the handle to prevent relative rotation between the barrel-shaped cleaning element and the handle in both directions so that the barrel-shaped cleaning element maintains the second outer diameter; and cleaning the inside of the gun barrel with the barrel-shaped cleaning element by moving the barrel-shaped cleaning element having the second outer diameter within the inside of the gun barrel while the outer surface of the barrel-shaped cleaning element contacts an inner surface of the gun barrel.

16. The method according to claim 15, further comprising positioning the barrel-shaped cleaning element inside the gun barrel after rotatably locking the other portion of the barrel-shaped cleaning element relative to the handle, and then performing said cleaning the inside of the gun barrel.

17. The method according to claim 15, further comprising positioning the barrel-shaped cleaning element inside the gun barrel before said rotating the barrel-shaped cleaning element relative to the handle.

18. The method according to claim 15, wherein the barrel-shaped cleaning element comprises a spirally wound element with axially adjacent windings and gaps between adjacent windings, and wherein said rotating of the barrel-shaped cleaning element relative to the handle while the other portion of the barrel-shaped cleaning element is in the rotatably unlocked position causes the adjacent windings to move either closer together or farther apart to thus change the outer diameter of the barrel-shaped cleaning element.

19. The method according to claim 15, wherein an outer surface of the cleaning element comprises a plurality of protrusions with tip ends, and the method comprises attaching a piece of cloth to the plurality of protrusions before inserting the cleaning element into the gun barrel.

* * * * *